United States Patent [19]

Martinec et al.

[11] 4,023,234

[45] May 17, 1977

[54] EDGE CLEANING NOZZLE CONSTRUCTION FOR SUCTION CLEANERS

[75] Inventors: Eugene F. Martinec, East Cleveland; Max L. Fairaizl, Chagrin Falls, both of Ohio

[73] Assignee: Health-Mor, Inc., Chicago, Ill.

[22] Filed: Nov. 5, 1975

[21] Appl. No.: 628,847

[52] U.S. Cl. ..... 15/331; 15/339; 15/402; 15/416

[51] Int. Cl.[2] ..... A47L 5/00

[58] Field of Search ..... 15/331, 339, 402, 415, 15/416, 421

[56] References Cited

UNITED STATES PATENTS

| | | | |
|---|---|---|---|
| 1,782,882 | 11/1930 | Rippey | 15/416 X |
| 2,348,861 | 5/1944 | Smellie | 15/416 X |
| 3,205,528 | 9/1965 | Fromknecht et al. | 15/416 |
| 3,936,903 | 2/1976 | Johnson | 15/416 X |
| 3,936,905 | 2/1976 | Stewart et al. | 15/416 |
| 3,942,216 | 3/1976 | Minton | 15/416 X |
| 3,942,219 | 3/1976 | Johnson | 15/416 X |

FOREIGN PATENTS OR APPLICATIONS

| | | | |
|---|---|---|---|
| 185,125 | 9/1936 | Switzerland | 15/416 |

*Primary Examiner*—Christopher K. Moore
*Attorney, Agent, or Firm*—Frease & Bishop

[57] ABSTRACT

A suction cleaner nozzle has main and edge cleaning secondary nozzle openings oriented at right angles to one another. An auxiliary passage connects the secondary nozzle with a zone of high suction in the suction source for the main nozzle. Valve means in the auxiliary passage may be moved selectively to open or closed position. A clean-out door is provided for the auxiliary passage.

12 Claims, 12 Drawing Figures

EDGE CLEANING NOZZLE CONSTRUCTION FOR SUCTION CLEANERS

RELATED PATENT

The edge cleaning arrangement is an improvement upon the suction cleaner nozzle construction disclosed in U.S. Pat. No. 3,818,540, dated June 25, 1974.

BACKGROUND OF THE INVENTION

1. Field of the Invention

The invention relates to suction cleaners and to a multiple nozzle opening nozzle construction for a suction cleaner normally used at the end of a wand, and which nozzle construction may include a power driven rotary brush in the normal main nozzle opening or passage. More particularly, the invention relates to the construction of such a nozzle with secondary edge cleaning nozzle means formed along at least one end edge of the main nozzle preferably extending at right angles with respect to the main nozzle opening to facilitate cleaning along the baseboard at a corner between a floor and a room side wall by movement of such one nozzle edge back and forth along the floor in close proximity to the baseboard.

2. Description of the Prior Art

The usual suction nozzle of a suction cleaner, whether an upright-type cleaner mounted on wheels and manipulated by a pivoted handle, or an attachment nozzle removably mounted on the end of a wand which in turn is connected by a flexible duct with an upright cleaner or a tank-type cleaner, or a canister-type cleaner, has an elongated main suction opening extending crosswise of the direction of movement of the nozzle across a floor, whether or not the main nozzle has an associated sweep or power driven brush.

It is simple to perform a normal cleaning operation by moving such usual suction cleaner nozzle to and fro across a floor or floor covering being cleaned. However, it is difficult to accomplish efficient cleaning with such usual nozzle along the baseboard at a corner between a room wall and floor.

Various prior devices have been proposed in which a secondary nozzle opening is provided located or extending along one end edge of the main nozzle forming walls communicating with the suction source passage for the main nozzle and having valve means at the suction source passage to cut off the suction to the main nozzle opening and bypass the suction to the secondary nozzle opening. Another prior device has involved a convertor attachment including a suction duct having at one end a secondary edge suction nozzle housing removably mounted exteriorly at an end of the main nozzle wall. The duct or tube means is provided at its other end with a convertor adapted in effect to be plugged into a suction passageway of various types of cleaners. Examples of such prior constructions are shown in U.S. Pat. Nos. 2,348,861 and 3,377,647.

Such prior constructions, while serving to accomplish so-called edge cleaning along baseboards in a reasonably efficient manner, involve complications in construction, operation and use. Thus, in the first described prior device, which involves a cut-off valve at the main suction passage, special passage housing walls enclosing a large segment of the device are used together with a complicated valve-actuating mechanism, which has actuating parts located inside of and outside of the various suction passages, and has an actuator which extends to the exterior of the cleaner housing for actuation.

The second described prior device involves a flexible tube or duct device having special convertor connector means at one end and removable nozzle means at the other end, which device must be mounted as a convertor attachment on the primary cleaner when used. The convertor connector at one end of the attachment must be adequately sealed when plugged into the convertor receiver opening. The auxiliary nozzle at the other end of the convertor attachment duct must be properly located and positioned with respect to the floor when placed on the main cleaner housing, in order to supply adequate cleaning suction for an edge cleaning operation.

Furthermore, neither of the prior devices provides access for easily cleaning foreign matter from the convertor or by-pass passage which may become lodged or stuck in the passage which connects the secondary edge cleaning nozzle with the primary source of cleaner suction.

Thus, a need exists in the suction cleaner field for a simplified cleaner nozzle construction having secondary nozzle means adapted for edge cleaning which eliminates the described prior art complications in construction and operation, which simplifies the valve means arrangement for the secondary edge cleaning nozzle, and which permits ready access to the passage communicating between the secondary nozzle and the main source of cleaner suction, for removing or clearing foreign material lodged in such passage.

SUMMARY OF THE INVENTION

Objectives of the invention include providing a multiple opening suction cleaner nozzle construction having a secondary nozzle opening located along one end edge of an elongated main nozzle opening and oriented preferably at right angles to the elongated main nozzle opening; providing a simple auxiliary passage in the nozzle forming walls of the suction cleaner nozzle connecting the secondary nozzle opening to a high suction location in the source of cleaner suction; locating a cut-off valve in the auxiliary passage with a simple valve actuator means accessible for operation at the exterior of the main nozzle; and providing movable clean-out door means for the auxiliary passage.

These and other objects and advantages may be obtained by the improved edge cleaning nozzle construction, the general nature of which may be stated as including in suction cleaner nozzle construction, housing walls forming an elongated main nozzle opening and a separate elongated edge cleaning secondary nozzle opening oriented at right angles to the main nozzle opening; means forming a main nozzle suction source communicating with the main nozzle opening adapted for connection with cleaner suction means; the housing having walls forming an auxiliary passage connecting the secondary nozzle with a zone of high suction in the main nozzle suction source; valve means in the auxiliary passage movable selectively to open or closed position; an actuator for the valve means movably mounted on the housing having an actuating finger accessible exteriorly of the housing; and movable clean-out door means for the auxiliary passage.

BRIEF DESCRIPTION OF THE DRAWINGS

A preferred embodiment of the invention — illustrative of the best mode in which applicants have contemplated applying the principles — is set forth in the following description and shown in the drawings and is particularly and distinctly pointed out and set forth in the appended claims.

Similar numerals refer to similar parts throughout the various figures of the drawings.

DESCRIPTION OF THE PREFERRED EMBODIMENT

Figure 1:
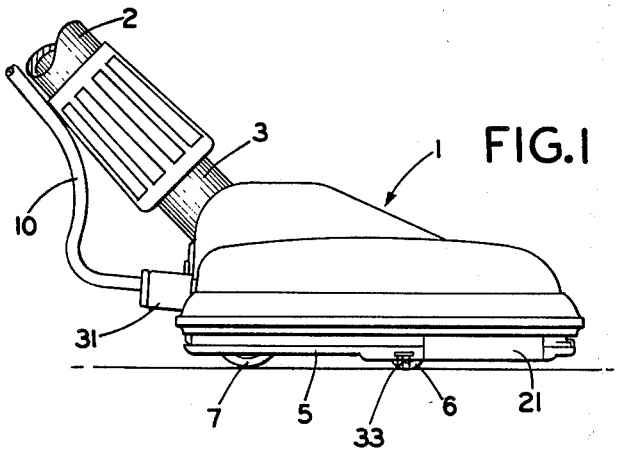
FIG. 1 is a side view of a wand-type power driven brush suction cleaner nozzle equipped with the improved edge cleaning secondary nozzle construction.
Figure 2:
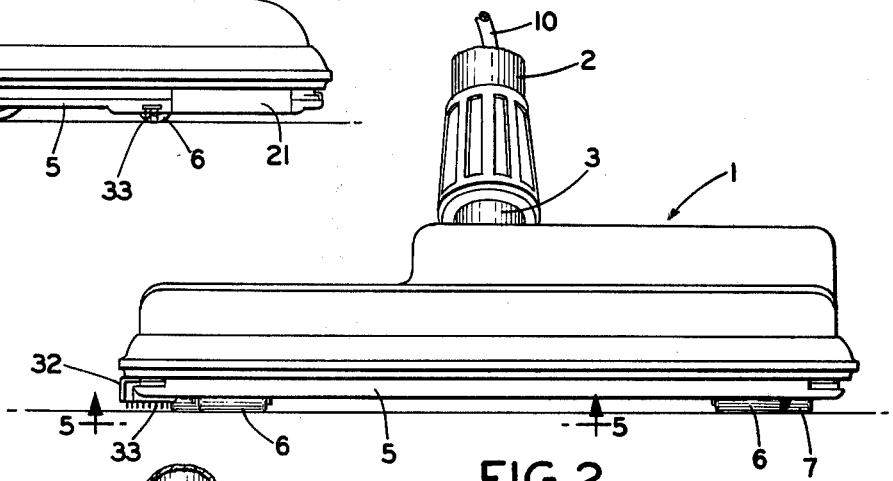
FIG. 2 is a front elevation of the device shown in FIG. 1.
Figure 3:
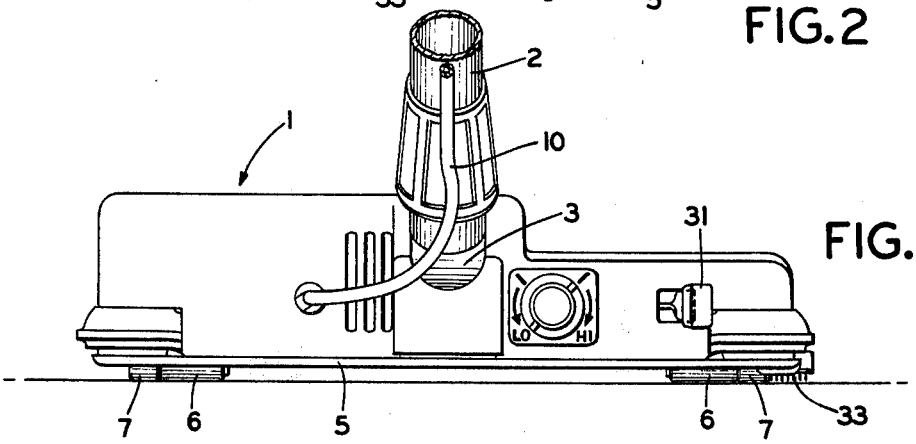
FIG. 3 is a rear elevation of the device shown in FIGS. 1 and 2.

The improved construction is illustrated and described as a modification of the general type of portable wand-type power nozzle shown in our U.S. Pat. No. 3,818,540, of June 25, 1974. The main nozzle housing is generally indicated at 1, and may be mounted at the end of a wand 2, pivotally connected by a tubular connector member 3 with the main suction duct 4 of the nozzle housing. The wand 2 may be connected by a hose, not shown, leading to a cleaner suction unit. The underside of the nozzle housing 1 may be covered or closed by a nozzle base plate 5 which has openings through which front adjustable wheels 6 and rear wheels 7 project for supporting the nozzle 1 on a floor over which the nozzle is moved. An elongated main nozzle opening means 8 is formed by windows in the base plate 5 beneath a rotary brush 9 (FIGS. 4 and 5) which may be power driven by a motor, not shown, mounted within the housing 1 above base plate 5 and supplied with power through an electrical cord 10 which is connected with the main cleaner unit.

Figure 5:
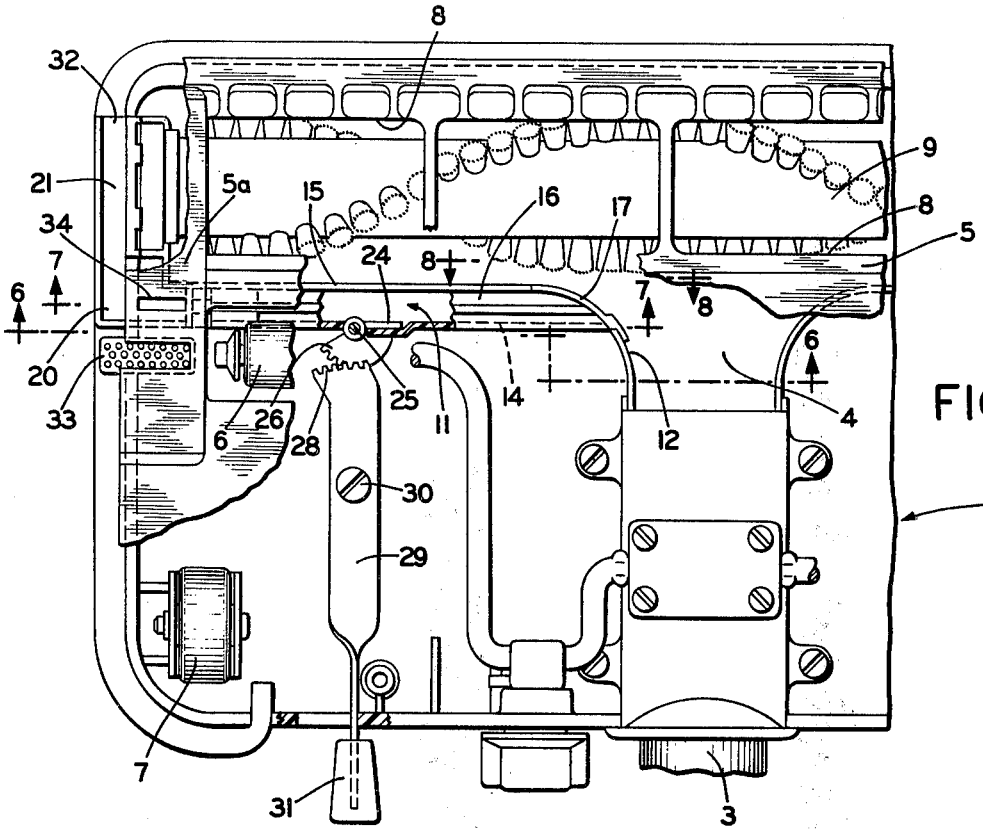
FIG. 5 is an enlarged fragmentary bottom plan view with parts broken away, looking in the direction of the arrows 5—5, FIG. 2, illustrating the auxiliary passage valve and its actuator in open position.
Figure 10:
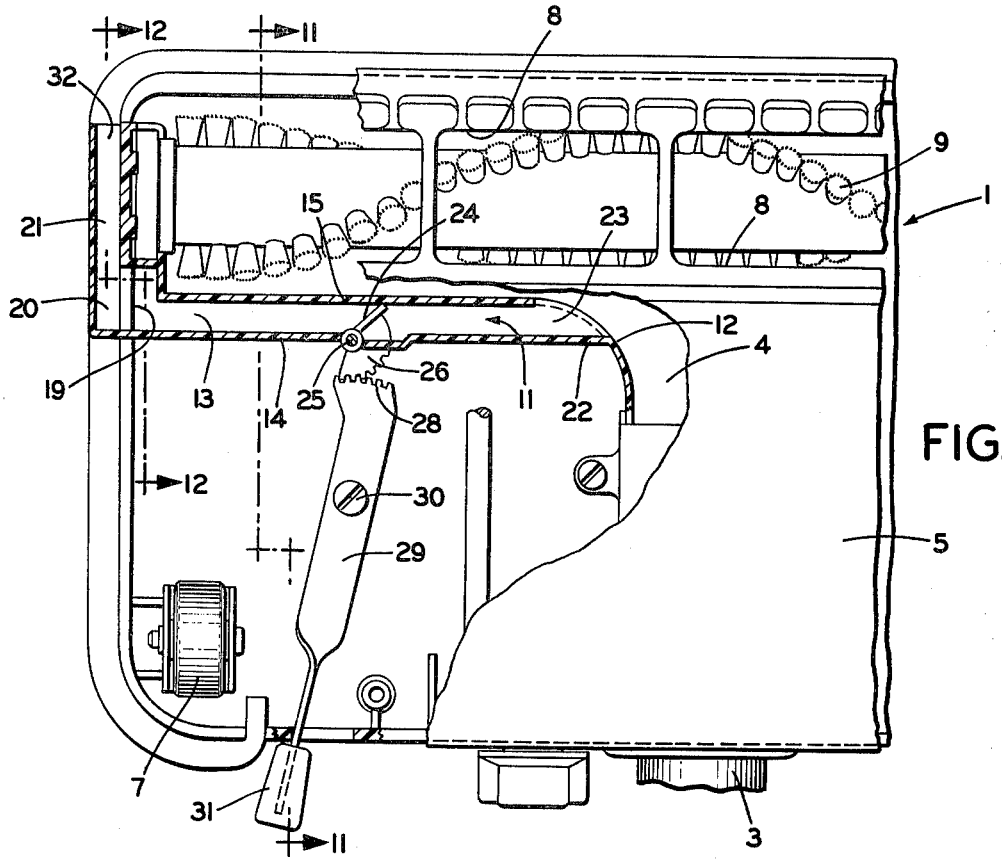
FIG. 10 is a view similar to FIG. 5 but showing the auxiliary valve and its actuator in closed position, parts being in section on the line 10—10, FIG. 6.

The base plate 5 is broken away in FIGS. 5 and 10 in order to illustrate the improved edge cleaning nozzle construction. An auxiliary passage 11 extends fromm the throat 12 of the main suction duct 4 where the throat 12 joins the main nozzle opening 8. The throat forms a zone of high suction.

Passage 11 has a top wall 13, a side wall 14, and another side wall 15 (FIG. 10) which also serves as a common wall for the rear side of the main nozzle opening 8. The bottom of passage 11 is closed by a hinged door 16 shown in full lines in closed position in FIG. 6 and in dot-dash lines in open position at 16*a*. The passage 11 thus has a rectangular cross section small in area with generally parallel side walls 14 and 15 and a top wall 13 parallel with the bottom wall closing door 16. Door 16 has a curved flange 17 which forms a connecting portion for the common wall 15 and the throat 12 of the main suction duct 4.

Figure 4:
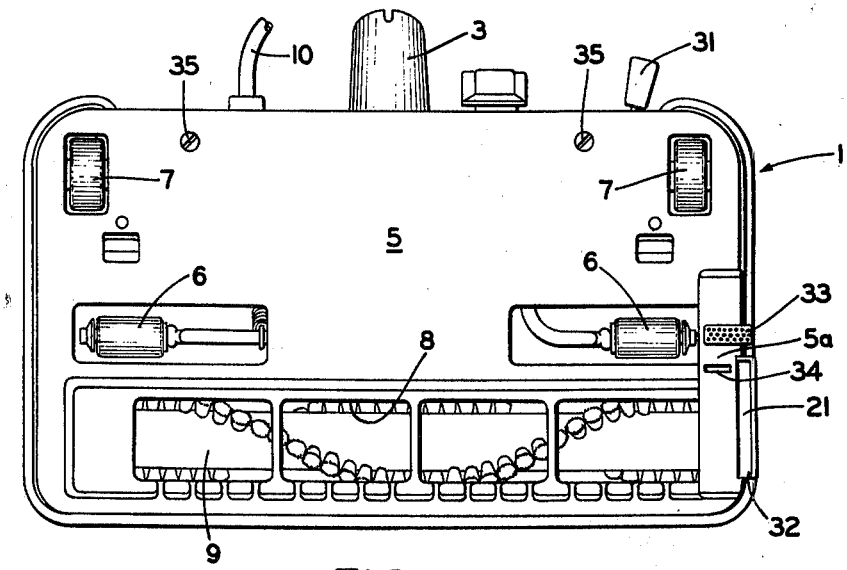
FIG. 4 is a bottom plan view of the cleaner nozzle shown in FIGS. 1, 2 and 3.

The passage 11 at its outer end 18 turns downward in a vertical leg 19 and then outward at 20 to a narrow elongated bottom opening slot 21 which forms the secondary edge cleaning nozzle opening that is oriented at right angles with respect to the main nozzle opening 8 (FIGS. 4 and 10). Portions of the nozzle base plate 5, at 5*a* (FIG. 6), cover the lower end of the vertical downwardly projecting leg 19 of passage 11.

Figure 8:
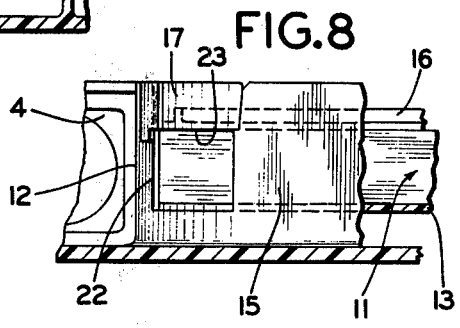
FIG. 8 is a fragmentary sectional view looking in the direction of the arrows 8—8, FIG. 5, illustrating the communication between the auxiliary passage and a high suction zone of the main source of cleaner suction.
Figure 11:
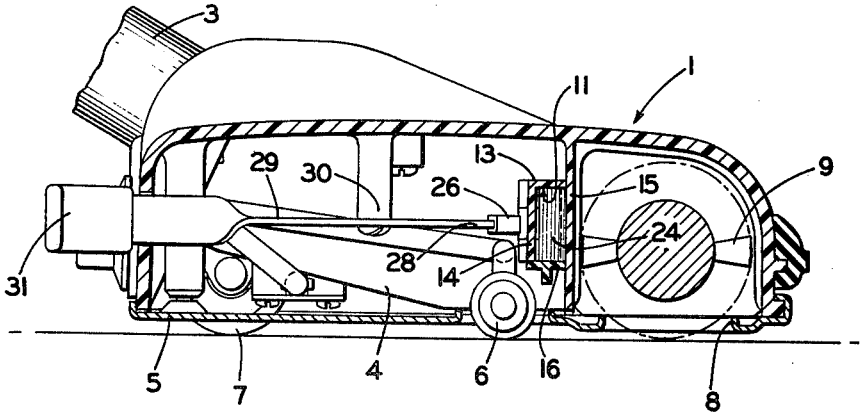
FIG. 11 is a sectional view looking in the direction of the arrows 11—11, FIG. 10.

The inner end 22 of passage 11 has a rectangular opening 23 (FIGS. 6, 8 and 10) below the door curved flange 17, which forms a communication between the passage 11 and the throat 12 of the main suction duct 4 of the nozzle housing 1 at the location where the throat flares to communicate with the main nozzle opening 8. Thus, the passage 11 communicates with the main suction duct 4 at the zone of high suction, and thus supplies the inner end 22 of passage 11 with high suction at all times. The cross-sectional area of duct 11 (FIGS. 8 and 11) is smaller than that of the main duct 4 (FIG. 6).

Figure 6:
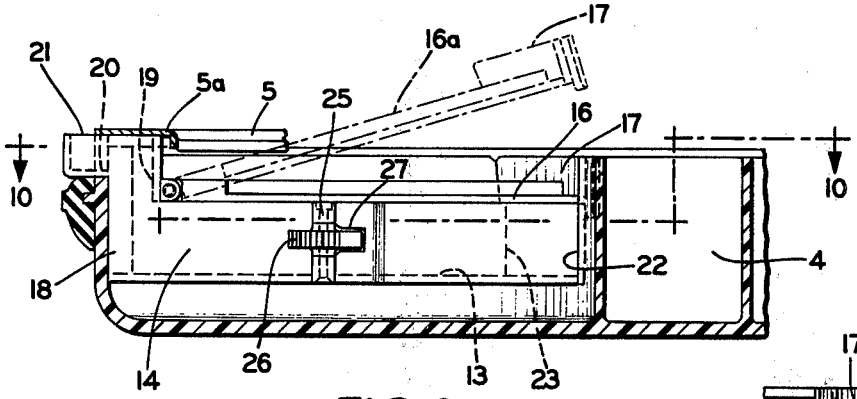
FIG. 6 is a sectional view looking in the direction of the arrows 6—6, FIG. 5.

The supply of high suction, however, to the secondary edge cleaning nozzle opening 21 at the end of the nozzle 1 is controlled by a flap valve member 24, shown in open position in FIGS. 5 and 6, and in closed position in FIG. 10. The flap valve 24 is pivoted on a vertical pivot 25 carried by the passage wall 14 and a gear segment 26 is connected with the flap valve 24 and projects through a slot 27 (FIG. 6) in an offset portion of passage wall 14. Gear segment 26 is engaged by gear teeth 28 at one end of a lever 29 which is pivoted intermediate its ends at 30 on housing 1 for moving the flap valve 24 between open and closed positions.

The other end 31 of lever 29 projects to the exterior of the nozzle housing 1 and is shown in valve open position in FIG. 5 and in valve closed position in FIG. 10. Lever 29 may be manually moved either by the hand or foot of the cleaning tool operator to open or close the valve 24 when desired, so as to supply a source of high suction to the auxiliary edge cleaning nozzle opening 21.

Figure 12:
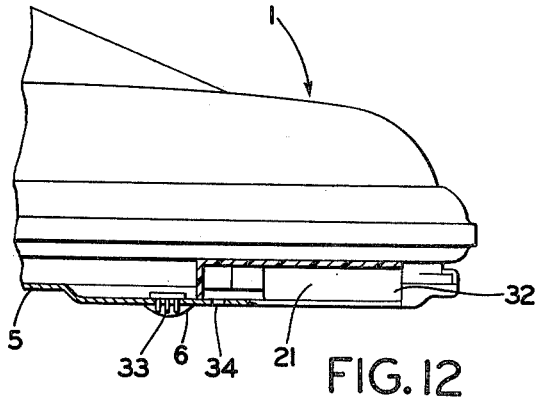
FIG. 12 is a fragmentary sectional view looking in the direction of the arrows 12—12, FIG. 10.

As best shown in FIGS. 10 and 12, the bottom opening slot 21 which forms the edge cleaning nozzle opening not only opens towards the bottom of the unit 1, but also opens toward the front of the unit 1, as indicated at 32. In this manner, when the control lever 29 is in open position, high suction air currents are drawn into the front 32 of and at the bottom of secondary nozzle opening 21 along the edge of one end of the nozzle unit 1, so as to provide edge cleaning as the nozzle unit 1 is moved to an fro along a baseboard at the bottom of a wall of a room.

Figure 7:
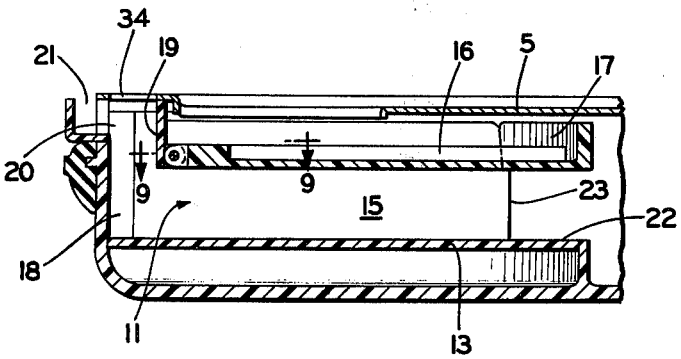
FIG. 7 is a sectional view offset from that of FIG. 6 looking in the direction of the arrows 7—7, FIG. 5.
Figure 9:
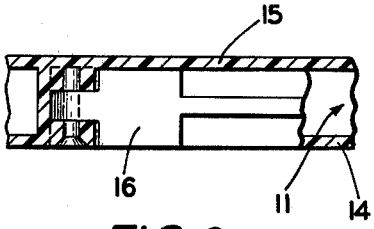
FIG. 9 is an enlarged fragmentary sectional view taken on the line 9—9, FIG. 7.

In addition, edge cleaning is further facilitated by the comb 33 which projects downward from the nozzle base plate 5 at the rear of the edge cleaning nozzle 21 (FIGS. 5 and 12) so as to dislodge threads or the like which may be located adjacent the baseboard on the floor or a carpet covering the floor that is being cleaned. In order to facilitate further the action of the comb 33, a narrow slot 34 is formed in the nozzle base plate 5 just below the lower end of the vertical down leg 19 of passage 11 (FIGS. 5, 7 and 12). Thus, suction exists at the slot 34 in front of the comb 33 whenever the valve 24 in passage 11 is in open position to create air currents in the zone of the comb 33 which tend to pick up foreign matter dislodged by the comb.

The auxiliary passage 11 connecting the source of high suction with the edge cleaning nozzle opening 21 has a small cross-sectional area in order to supply high suction to the edge cleaning nozzle. Because of the small cross-sectional area of the passage 11, and the various turns therein between the nozzle opening 21, the outturned portions 20, and the vertical down leg 19, foreign matter drawn into the passage 11 may become lodged therein and block the passage or cut down the effectiveness of edge cleaning.

Whenever such blockage occurs, the base plate 5 may be removed by removing screws 35, in the same manner as is done for changing a brush or replacing a belt in the nozzle housing 1. Upon temporary removal of the base plate 5, the clean-out door 16 may be pivoted to an open position such as diagrammatically indicated at 16*a* in FIG. 6, whereupon substantially the entire passage 11 is exposed. Removal of the base plate 5 also exposes the down leg 19 and outturned portion 20 of the passage for cleaning, in a manner such as indicated in FIG. 10 which is a section taken below the door 16 through the passage 11.

The improved construction provides an auxiliary edge cleaning nozzle connected directly with a zone of high suction in the main suction duct for the nozzle unit 1 without complicated arrangement and structure for the auxiliary passage; provides a simple flap valve intermediate the ends of a small cross-sectional area passage to cut off suction to the secondary edge cleaning nozzle without requiring this suction control valve to close the main suction duct beyond the auxiliary intake when suction is applied to the auxiliary passage; provides a simple valve control mechanism for the auxiliary passage valve; provides a combined bottom and front opening secondary edge cleaning nozzle extending at right angles to the main nozzle opening at one end of the latter; provides suction swept comb means adjacent the edge cleaning nozzle; provides clean-out means for the auxiliary suction passage leading to the edge cleaning nozzle and provides a simplified multiple opening edge cleaning nozzle construction for suction cleaners which incorporates the new and advantageous features described, overcomes the prior art difficulties indicated, solves problems and obtains the new results described, and satisfies the need existing in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features of the invention, the manner in which the improved secondary edge cleaning nozzle construction is constructed and operated, the characteristics of the new construction, and the advantageous, new and useful results obtained; the new and useful structures, devices, elements, arrangements, parts and combinations are set forth in the appended claims.

We claim:

1. In a multiple-nozzle-opening suction cleaner nozzle construction, housing walls forming an elongated main nozzle opening and a separate elongated edge cleaning secondary nozzle opening oriented at right angles to the main nozzle opening at one end of the latter; main suction duct means having a throat connected with the main nozzle opening; walls forming an auxiliary passage having a rectangular cross section with an area smaller than the cross-sectional area of the main suction duct means; means connecting one end of the auxiliary passage with the suction duct throat and the other auxiliary passage end with the secondary nozzle opening; valve means in the auxiliary passage intermediate the ends of the latter; valve actuator means mounted on the housing and connected with the valve means for moving the valve means between open and closed positions and having an end accessible exteriorly of the housing; and clean-out door means pivoted at one end on the nozzle walls and movable between open and closed positions, said door means extending along and forming one wall of the rectangular cross section of the auxiliary passage when in closed position and exposing said auxiliary passage when in open position.

2. The construction defined in claim 3 in which opposite auxiliary passage walls are parallel with one another.

3. The construction defined in claim 1 in which the auxiliary passage connection with the suction duct throat is located at a zone of high suction.

4. The construction defined in claim 1 in which the valve means includes a flap valve pivotally mounted on one of the passage walls and movable to an open position parallel with one of the passage walls and to closed position extending across the passage.

5. The construction defined in claim 4 in which the flap valve is pivoted on a vertical pivot axis.

6. The construction defined in claim 4 in which the valve actuator includes a lever pivoted intermediate its ends on the housing; means engageable between one end of the lever and the flap valve for moving the flap valve between open and closed positions upon pivotal movement of the lever; and the other end of the lever being accessible exteriorly of the housing.

7. The construction defined in claim 6 in which the engageable means between the lever and the flap valve includes engageable gear segments on the flap valve and lever.

8. The construction defined in claim 1 in which the secondary nozzle includes walls forming slot means opening toward the bottom and toward the front of the cleaner nozzle.

9. In multiple-nozzle-opening suction cleaner nozzle construction, housing walls forming an elongated main nozzle opening and a separate elongated edge cleaning secondary nozzle opening oriented at right angles to the main nozzle opening at one end of the latter; main suction duct means having a throat connected with the main nozzle opening; walls forming an auxiliary passage having a rectangular cross section with an area smaller than the cross-sectional area of the main suction duct means; means connecting one end of the auxiliary passage with the suction duct throat and the other auxiliary passage end with the secondary nozzle opening; a rmovable nozzle base plate covering the auxiliary passage walls and provided with means forming the main nozzle opening; comb means carried by the base plate and projecting downwardly of said base plate at the rear of the secondary nozzle opening; a slot formed in the base plate adjacent the comb means and communicating with the auxiliary passage; valve means in the auxiliary passage intermediate the ends of the latter; and valve actuator means mounted on the housing and connected with the valve means for moving the valve means between open and closed positions and having an end accessible exteriorly of the housing.

10. The construction defined in claim 9 in which clean-out door means is pivotally mounted on the nozzle walls and movable between open and closed positions; and in which said door means extends along and forms one wall of the rectangular cross section of the auxiliary passage when in closed position and exposes said auxiliary passage when in open position.

11. The construction defined in claim 9 in which the valve means includes a flap valve pivotally mounted on one of the passage walls and movable to an open position parallel with one of the passage walls and to closed position extending across the passage; in which the valve actuator means includes a lever pivotally mounted intermediate its ends on the housing; and in which one end of the lever is operatively engageable with the flap valve for moving the flap valve between open and closed positions upon pivotal movement of the lever, and in which the other end of the lever is accessible exteriorly of the housing.

12. The construction defined in claim 9 in which the secondary nozzle includes walls forming slot means opening toward the bottom and toward the front of the cleaner nozzle.

* * * * *

UNITED STATES PATENT AND TRADEMARK OFFICE

CERTIFICATE OF CORRECTION

PATENT NO. : 4,023,234

DATED : May 17, 1977

INVENTOR(S) : Eugene F. Martinec and Max L. Fairaizl

It is certified that error appears in the above-identified patent and that said Letters Patent are hereby corrected as shown below:

Column 3, line 62, change "fromm" to -from-;

Column 4, line 25, change "the" to -a-;

Column 4, line 52, change "towards" to -toward-;

Column 4, line 59, change "an" to -and-; and

Column 6, line 68, change "rmovable" to -removable-.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*